United States Patent [19]

Aoki et al.

[11] Patent Number: 4,579,813

[45] Date of Patent: Apr. 1, 1986

[54] SILVER HALIDE COLOR PHOTOGRAPHIC MATERIALS

[75] Inventors: Kozo Aoki; Takayoshi Kamio; Toshiyuki Watanabe, all of Kanagawa, Japan

[73] Assignee: Fuji Photo Film Co., Ltd., Kanagawa, Japan

[21] Appl. No.: 645,148

[22] Filed: Aug. 28, 1984

[30] Foreign Application Priority Data

Aug. 29, 1983 [JP] Japan ..... 58-157423

[51] Int. Cl.[4] ..... G03C 1/46

[52] U.S. Cl. ..... 430/505; 430/553; 430/558

[58] Field of Search ..... 430/385, 553, 505, 558

[56] References Cited

U.S. PATENT DOCUMENTS 4,450,228 5/1984 Shimba et al. ..... 430/505
4,458,012 7/1984 Ito et al. ..... 430/553
4,489,155 12/1984 Sakanoue et al. ..... 430/553

FOREIGN PATENT DOCUMENTS 0073145 2/1983 European Pat. Off. ..... 430/553

*Primary Examiner*—J. Travis Brown

*Attorney, Agent, or Firm*—Sughrue, Mion, Zinn, Macpeak and Seas

[57] ABSTRACT

A silver halide color photographic material comprising a support having thereon at least a silver halide emulsion layer is described, wherein the photographic material contains a cyan dye-forming coupler represented by formula (I)

(I)

wherein R represents an unsubstituted or substituted alkyl, aryl, or heterocylic ring group; B represents —O— or —$NR_1$—, wherein $R_1$ represents a hydrogen atom or an unsubstituted or substituted alkyl or aryl group; Z represents an unsubstituted or substituted aryl group or an alkyl or aralkyl group substituted by a carboxy group or a hydroxy group; A represents a substituted aryl group, or a substituted or unsubstituted heterocyclic ring group; and m represents 0 or 1, provided that when m is 0 the substituent is not an alkoxy group, a halogen atom or a cyano group.

10 Claims, No Drawings

SILVER HALIDE COLOR PHOTOGRAPHIC MATERIALS

FIELD OF THE INVENTION

This invention relates to cyan dye-forming couplers, and more particularly, to silver halide color photographic materials containing novel 2-equivalent cyan couplers.

BACKGROUND OF THE INVENTION

When a silver halide color photographic material is imagewise exposed and subjected to color development, dye-forming couplers react with an oxidized aromatic primary amine developing agent to form color images. In general, in the photographic process, a color reproduction process by a subtractive color photographic process is used and for reproducing blue, green, and red images, yellow, magenta and cyan color images which are in the complementary color relation with the foregoing colors, respectively, are formed.

In this case, for the formation of cyan color images, phenol derivatives or naphthol derivatives are mainly used as the couplers. In a color photographic process, a color-forming coupler is added in a developer or is incorporated in a photosensitive photographic silver halide emulsion layer or other color image-forming layer, and by reacting with the oxidation product of a color developing agent formed by a development, a nondiffusible dye is formed.

The reaction of the coupler and the oxidized color developing agent occurs at an active site on the coupler (usually referred to as the coupling position) and the coupler having a hydrogen atom at the active site is a 4-equivalent coupler, that is, a coupler which stoichiometrically requires 4 moles of silver halide having development centers for forming 1 mole of dye. On the other hand, a coupler having at the active site a group capable of being released as an anion is a 2-equivalent coupler, that is, a coupler which requires only 2 moles of silver halide having development centers for forming 1 mole of dye. Accordingly, in the case of using the 2-equivalent coupler, the amount of silver halide in a silver halide emulsion layer can generally be reduced, and hence the layer thickness can be reduced as compared to the case of using the 4-equivalent coupler, whereby the processing time for the photographic material can be shortened, and the sharpness of the color images is improved.

Typical examples of such releasable groups include a sulfonamide group as described in U.S. Pat. No. 3,737,316; an amido group as described in U.S. Pat. No. 3,749,735; a sulfonyl group as described in U.S. Pat. No. 3,622,238; an aryloxy group as described in U.S. Pat. No. 3,476,563; an acyloxy group as described in U.S. Pat. No. 3,311,476; a thiocyano group as described in U.S. Pat. No. 3,214,437; an isothiocyanate group as described in U.S. Pat. No. 4,032,345; a sulfonyloxy group as described in U.S. Pat. No. 4,046,573; an alkylthio group as described in U.S. Pat. No. 3,227,554; a thiocarbonyloxy group as described in Japanese Patent Application (OPI) No. 51939/77 (the term "OPI" as used herein refers to a "published unexamined Japanese patent application"); an aralkenylcarbonyloxy group as described in Japanese Patent Publication No. 46059/82; an acylamino group as described in Japanese Patent Application (OPI) No. 21828/76; an aminomethyl group as described in Japanese Patent Application (OPI) No. 52828/76 and Japanese Patent Publication No. 6537/81; heterocyclic oxy groups as described in Japanese Patent Application (OPI) Nos. 37425/72 and 200039/82; and substituted alkoxy groups as described in U.S. Pat. No. 3,227,551, Japanese Patent Application (OPI) Nos. 90932/77, 99938/78, 105226/78, 14736/79, 66129/79, 32071/80, 65957/80, 1938/81, 6593/81, 12643/81, 27147/81 and 80044/81 and Japanese Patent Publication Nos. 120334/75, 37822/79, 6539/81, 3934/82 and 46060/82.

Furthermore, by properly selecting the releasable group of a coupler, it is possible to incorporate, for example, a diffusible dye moiety in the releasable group and apply the coupler to a diffusion transfer photographic system of forming dye images of diffusible dye in an image-receiving layer by utilizing the releasing dye. Couplers of this type are called "diffusible dye-releasing couplers" and they are described, for example, in U.S. Pat. Nos. 3,227,550 and 3,765,886, U.S. Defensive Publication T900,029, British Pat. No. 1,330,524, etc.

Also, certain kinds of colored 2-equivalent couplers have a masking effect for color correcting dye images. These couplers are called "colored couplers" and are described, for example, in Japanese Patent Application (OPI) No. 26034/76.

A 2-equivalent coupler having a releasable product which has the effect of inhibiting development is called a "development inhibitor-releasing coupler", and since the coupler inhibits the development in proportion to the amount of developed silver, the coupler has the effects of fining image grains, controlling gradation of images, improving the color reproducibility, etc. Also, the coupler can be utilized for a diffusion transfer system by utilizing the action to the adjacent layer. Such couplers are described, for example, in U.S. Pat. No. 3,227,554, Japanese Patent Application (OPI) No. 122335/74, West German Patent Application (OLS) No. 2,414,006, etc.

Since 2-equivalent couplers essentially have several excellent advantages as compared with 4-equivalent couplers as described above, 2-equivalent couplers tend to be frequently used.

On the other hand, phenol series cyan couplers having a ureido group at the 2-position and an acylamino group at the 5-position are said to form color images excellent in fastness to heat or light by color development as compared to other phenol series cyan couplers or naphthol series couplers and these cyan couplers are described, for example, in Japanese Patent Application (OPI) Nos. 65134/81, 204543/82, 204554/82, 204545/82, 33249/83, 33250/83, 33251/83, 33252/83, etc. These cyan couplers include 2-equivalent couplers.

However, conventional phenol series 2-equivalent cyan couplers having a ureido group at the 2-position and an acylamino group at the 5-position have some disadvantages in that their coupling reactivity is insufficient, they have a significant color fog problem, they have poor dispersibility thus cause coating problems, and such couplers are unstable and hence cannot be stored for a long period of time without degradation. Also, the stability of the color images formed by color development by heat or light is still insufficient in the case of storing the color images for a long period of time.

SUMMARY OF THE INVENTION

A primary object of this invention, therefore, is to eliminate the above-described disadvantages of conventional couplers, and provide silver halide color photographic materials using novel 2-equivalent cyan couplers having very excellent coloring property and dispersibility.

Also, other object of this invention is to provide 2-equivalent cyan couplers showing substantially no reduction in coloring density in the case of processing the color photographic materials containing the couplers in a bleach solution having a weak oxidative power or a fatigued bleach solution.

The above-described objects of this invention can be achieved by the silver halide color photographic materials of this invention. That is, according to this invention, a silver halide color photographic material comprising a support having thereon at least a silver halide emulsion layer is provided wherein the photographic material contains a cyan dye-forming coupler represented by formula (I)

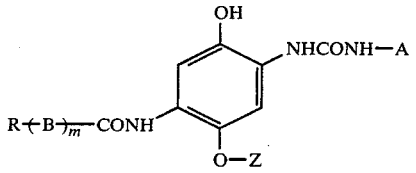

(I)

wherein R represents an unsubstituted or substituted alkyl, aryl, or heterocyclic ring group; B represents —O— or —$NR_1$—, wherein $R_1$ represents a hydrogen atom or an unsubstituted or substituted alkyl or aryl group; Z represents an unsubstituted or substituted alkyl, alkenyl, aralkyl, aralkenyl, cycloalkyl, aryl, or heterocyclic ring group; A represents an unsubstituted or substituted alkyl, aryl, or heterocyclic ring group; and m represents 0 or 1, provided that when m is 0 and A is a substituted aryl group, the substituent is not an alkoxy group, a halogen atom, or a cyano group.

DETAILED DESCRIPTION OF THE INVENTION

Then, the cyan dye-forming couplers shown by above general formula (I) will be explained below in detail.

R in formula (I) represents a chain or cyclic alkyl group having, preferably, from 1 to 22 carbon atoms (e.g., a methyl group, a butyl group, a pentadecyl group, a cyclohexyl group, etc.), an aryl group (e.g., a phenyl group, a naphthyl group, etc.), or a heterocyclic ring group (e.g., a 2-pyridyl group, 4-pyridyl group, a 2-thienyl group, a 2-oxazolyl group, a 2-imidazolyl group, etc.). These groups may have a substituent such as an alkyl group, an aryl group, a heterocyclic ring group, an alkoxy group (e.g., a methoxy group, a dodecyloxy group, a 2-methoxyethoxy group, etc.), an aryloxy group (e.g., a phenoxy group, a 2,4-di-tert-amylphenoxy group, a 3-tert-butyl-4-hydroxyphenoxy group, a naphthyloxy group, etc.), a carboxy group, a carbonyl group (e.g., an acetyl group, a tetradecanoyl group, a benzoyl group, etc.), an ester group (e.g., a methoxycarbonyl group, a phenoxycarbonyl group, an acetoxy group, a benzoyloxy group, a butoxysulfonyl group, a toluenesulfonyloxy group, etc.), an amido group (e.g., an acetylamino group, an ethylcarbamoyl group, a methanesulfonylamido group, a butylsulfamoyl group, etc.), an imido group (e.g., a succinimido group, a hydantoinyl group, etc.), a sulfonyl group (e.g., a methanesulfonyl group, etc.), a hydroxy group, a cyano group, a nitro group, and a halogen atom.

B in formula (I) represents —O— or —$NR_1$— and $R_1$ represents a hydrogen atom, a chian or cyclic alkyl group having, preferably, from 1 to 22 carbon atoms (e.g., a methyl group, a butyl group, a dodecyl group, a cyclohexyl group, etc.), or an aryl group (e.g., a phenyl group, a naphthyl group, etc.). These groups may have as a substituent each of the substituents described above in regard to the substituents of R.

In formula (I), m represents 0 or 1.

Z in formula (I) represents an alkyl group having 1 to 18 carbon atoms (e.g., a methyl group, an ethyl group, an n-propyl group, an i-propyl group, an n-butyl group, an i-butyl group, a t-butyl group, an n-hexyl group, an n-octyl group, an n-dodecyl group, an n-octadecyl group, etc.), an alkenyl group having from 2 to 18 carbon atoms (e.g., a propenyl group, a butenyl group, an octenyl group, etc.), an aralkyl group having 7 to 18 carbon atoms (e.g., a benzyl group, a phenylethyl group, etc.), an aralkenyl group having 8 to 18 carbon atoms (e.g., a phenylpropenyl group, etc.), a cycloalkyl group (e.g., a cyclopentyl group, a cyclohexyl group, a methylcyclohexyl group, a cycloheptyl group, etc.), an aryl group having 6 to 12 carbon atoms (e.g., a phenyl group, a naphthyl group, etc.), or a 5-membered or 6-membered heterocyclic ring group (said heterocyclic ring may further have an oxygen atom, a sulfur atom and/or a nitrogen atom in addition to one nitrogen atom; examples of the heterocyclic ring group are an imidazolyl group, a pyrazolyl group, a triazolyl group, a tetrazolyl group, a thiazolyl group, a piperadyl group, etc.).

The alkyl group, alkenyl group, aralkyl group, aralkenyl group, cycloalkyl group, aryl group, and heterocyclic group shown by Z may have a substituent such as a halogen atom (e.g., fluorine, chlorine, bromine, etc.), a cyano group, a hydroxy group, an alkoxy group (e.g., a methoxy group, an ethoxy group, a propyloxy group, a butoxy group, an octyloxy group, etc.), an aryloxy group (e.g., a phenoxy group, etc.), an acyloxy group (e.g., an acetyloxy group, a propionoyloxy group, a butyloyloxy group, a benzoyloxy group, etc.), an acylamino group (e.g., a formamino group, an acetylamino group, a propionoylamino group, a benzoylamino group, etc.), a sulfonamido group (e.g., a methylsulfonamido group, an octylsulfonamido group, a benzenesulfonamido group, etc.), a sulfamoyl group (e.g., an unsubstituted sulfamoyl group, a methylsulfamoyl group, an ethylsulfamoyl group, a propylsulfamoyl group, a phenylsulfamoyl group, etc.), a sulfonyl group (e.g., a methylsulfonyl group, an ethylsulfonyl group, an octylsulfonyl group, a benzenesulfonyl group, etc.), a carboxy group, a sulfo group, a nitro group, an arylthio group (e.g., a phenylthio group, etc.), an alkylthio group (e.g., a methylthio group, an ethylthio group, etc.), a carbamoyl group (e.g., an ethylcarbamoyl group, a phenylcarbamoyl group, etc.), an alkoxycarbonyl group (e.g., a methoxycarbonyl group, an ethoxycarbonyl group, etc.), a sulfinyl group (e.g., a methylsulfinyl group, a phenylsulfinyl group, etc.), a phosphoric acid amido group (e.g., a diethylphosphoric acid ester monoamido group, etc.), a heterocyclic group (e.g., a pyrazolyl group, a triazolyl group, etc.). These substituents each may be further substituted by one, or two or more of these substituents. Therein, when the substituent has two or more substituent groups, the groups may be the same or different.

In formula (I), A represents a chain or cyclic alkyl group having, preferably, from 1 to 32 carbon atoms (e.g., a methyl group, a butyl group, a tridecyl group, a cyclohexyl group, etc.), an aryl group (e.g., a phenyl group, a naphthyl group, etc.), or a heterocyclic group (e.g., a 2-pyridyl group, a 2-imidazolyl group, a 2-furyl group, a 6-quinolyl group, etc.). These groups may have a substituent such as an alkyl group, an aryl group, a heterocyclic group, an alkoxy group (e.g., a methoxy group, a 2-methoxyethoxy group, etc.), an aryloxy group (e.g., a phenoxy group, a 2,4-di-tert-amylphenoxy group, a 2-chlorophenoxy group, etc.), a carboxy group, a carbonyl group (e.g., an acetyl group, a benzoyl group, etc.), an ester group (e.g., a methoxycarbonyl group, a phenoxycarbonyl group, an acetoxy group, a benzoyloxy group, a butoxysulfonyl group, a toluenesulfonyloxy group, etc.), an amido group (e.g., an acetylamino group, an ethylcarbamoyl group, a dimethylcarbamoyl group, a methanesulfonamido group, a butylsulfamoyl group, etc.), a sulfonamido group (e.g., a dipropylsulfamoylamino group, etc.), an imido group (e.g., a succinimido group, a hydantoinyl group, etc.), a ureido group (e.g., a phenylureido group, a dimethylureido group, etc.), a sulfonyl group (e.g., a methanesulfonyl group, etc.), a hydroxy group, a cyano group, a nitro group, a halogen atom, a thio group (e.g., an ethylthio group, a phenylthio group, etc.), etc.

However, when m is 0 and A is a substituted aryl group, the substituent is not an alkoxy group, a halogen atom, or a cyano group.

Preferred R groups in formula (I) are substituted alkyl groups and substituted aryl groups.

Preferred B group in formula (I) is —O—.

Preferred A groups in formula (I) are substituted aryl group and unsubstituted or substituted heterocyclic ring groups.

Preferred Z groups in formula (I) are aryl groups, heterocyclic groups, and alkyl and aralkyl groups substituted by a carboxy group or a hydroxy group. Among these groups, aryl groups are particularly preferred.

Preferred m is 0.

The feature of the compound shown by formula (I) (hereinafter referred to as the "coupler of this invention") is that the compound has a ureido group at the 2-position, a carbonylamino group at the 5-position, and a group such as —O—Z defined in formula (I) at the 4-position as a group released by coupling, and it is considered that this combination of features provides various desired properties.

That is, since the colorless 2-equivalent cyan coupler of this invention is excellent in coloring property and can provide a very high sensitivity, good gradation, and very high maximum density, the coupler of this invention can reduce the amount of silver halide as well as is suitable for not only ordinary photographic processing, but also quick photographic processing. Furthermore, the coupler of this invention is excellent in solubility in a high boiling organic solvent and dispersing stability in a photographic emulsion, and does not form fog, color stain, etc., when the coupler is used for a silver halide photographic emulsion layer. Also, the dye obtained from the cyan coupler of this invention has excellent fastness to light, heat, and humidity, does not have unnecessary light absorption, shows a sharp absorption, and has good spectral absorption characteristics. Still further, the coupler of this invention does not show any substantial reduction of the coloring density even in the case of processing the color photographic material containing the coupler in a bleach solution having a weak oxidative power or a fatigued bleach solution.

On the other hand, the effects obtained by the couplers of this invention are astonishingly excellent as compared to the 2-equivalent couplers described in above-described U.S. Pat. No. 4,333,999, Japanese Patent Application (OPI) Nos. 204543/82, 204544/82, 204545/82, 33249/83, 33250/83, 33251/83, 33252/83, etc.

Some practical examples of the couplers of this invention are illustrated below, but the couplers of this invention are not limited to these compounds.

These practical examples are described based on the noted designated groups for A, Z, and R' in the following formula (II):

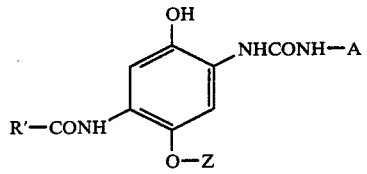

(II)

| Coupler No. | R' | Z | A |
|---|---|---|---|
| 1 | 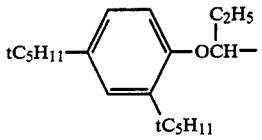 | —(CH2)3COOH | 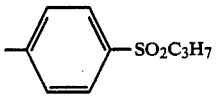 |
| 2 | 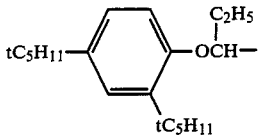 | —CH2CH2SCH2COOH | 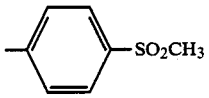 |

-continued
| Coupler No. | R′ | Z | A |
|---|---|---|---|
| 3 | 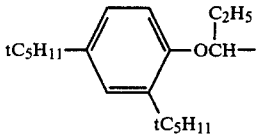 | 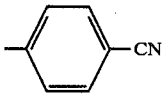 | 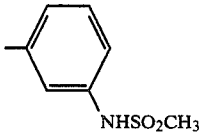 |
| 4 | 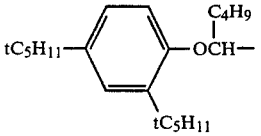 | 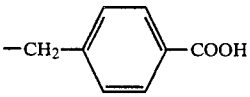 | 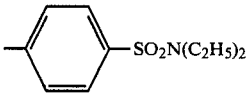 |
| 5 | 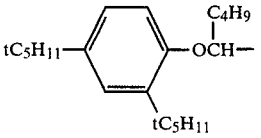 | $-CH_2CH_2OCH_2CH_2OH$ | 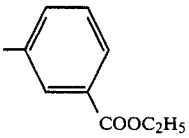 |
| 6 | 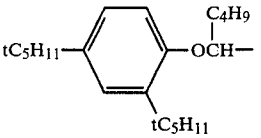 | 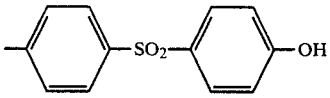 | 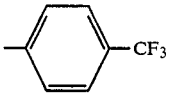 |
| 7 | 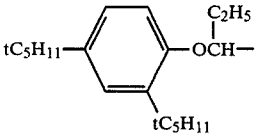 | $\leftarrow CH_2)_3COOH$ | 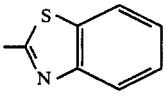 |
| 8 | 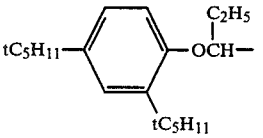 | 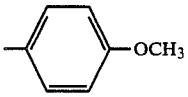 | 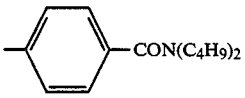 |
| 9 | 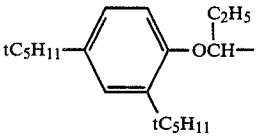 | 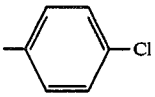 | 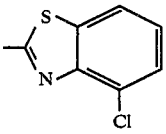 |
| 10 | 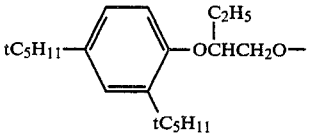 | $\leftarrow CH_2)_3COOH$ | 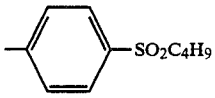 |
| 11 | 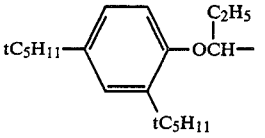 | 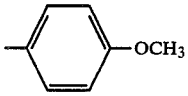 | 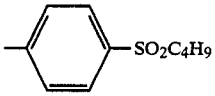 |
| 12 | 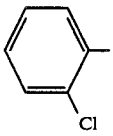 | $-(CH_2)_2SCHC_{12}H_{25}$ (COOH) | 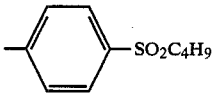 |

-continued
| Coupler No. | R' | Z | A |
|---|---|---|---|
| 13 | $CH_3-C(CH_3)_2-$ | $-(CH_2)_{10}COOH$ | 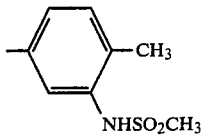 |
| 14 | 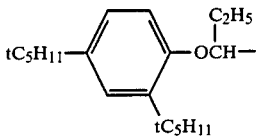 | 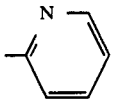 | 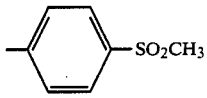 |
| 15 | 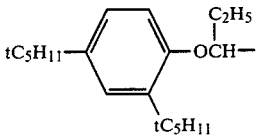 | 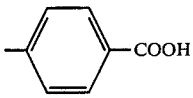 | 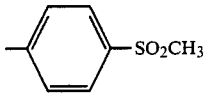 |
| 16 | 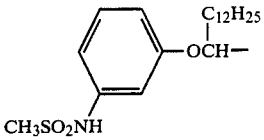 | 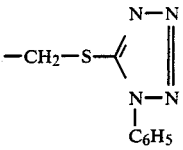 | 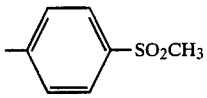 |
The couplers of this invention can be prepared by various processes and typical synthesis routes and synthesis processes are shown hereinafter.
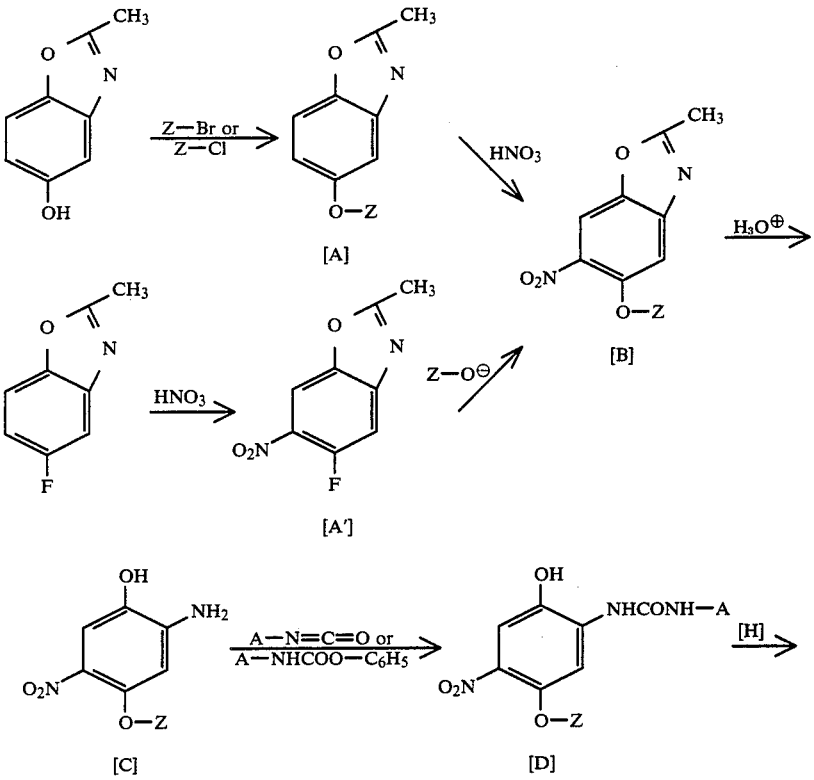

-continued

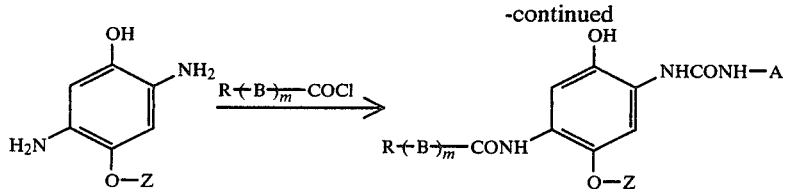

[E]

R, B, Z, A, and m are as defined in regard to formula (I).

SYNTHESIS EXAMPLE 1

Synthesis of Coupler No. 1

In a reaction vessel were placed 116 g of 5-hydroxy-2-methylbenzoxazole, 175 g of γ-bromoethyl n-butyrate, 160 g of potassium carbonate, and 450 ml of dimethylformamide, and the mixture was heated on a steam bath for 3 hours. After removing inorganic matter from the reaction mixture by filtration, the reaction mixture was extracted with ethyl acetate and the extract was washed with water and then concentrated under reduced pressure to provide 210 g of oily product [A] (in the above synthesis route).

Then, the 210 g of product [A] was added to 400 ml of concentrated sulfuric acid under ice-cooling and further 52 ml of nitric acid (d=1.42) was added dropwise to the mixture while maintaining the temperature thereof below 15° C. After stirring the mixture for 30 minutes, the reaction mixture was poured into ice water and crystals thus precipitated were collected by filtration to provide 200 g of product [B] having a melting point of 103° to 104° C.

Then, 131 g of the product [B], 400 ml of ethanol, and 50 ml of hydrochloric acid were placed in a reaction vessel and after conducting the reaction for 8 hours at 50° to 60° C., the reaction mixture was poured into water and crystals thus precipitated were collected by filtration to provide 105 g of product [C].

Then, 56.5 g of the product [C] was added to 400 ml of acetonitrile and after further adding thereto 63.4 g of p-phenoxycarbonylaminophenylpropylsulfone and 1.4 g of imidazole, the mixture was refluxed for 4 hours. The reaction mixture thus formed was cooled and after adding thereto 300 ml of water, crystals thus precipitated were collected by filtration to provide 88 g of product [D].

Then, 51 g of the product [D] and 2 g of palladium-carbon were added to 250 ml of dimethylacetamide and the mixture was placed in an autoclave to perform a catalytic reduction. After absorption of a theoretical amount of hydrogen, the catalyst was filtered off and 35.6 g of 2-(2,4-di-tert-amylphenoxy)butyryl chloride was added to the filtrate thus obtained, followed by stirring for 2 hours at 60° C. After cooling, the reaction mixture was poured into water and extracted with ethyl acetate, and after washing the extract with water, the solvent was distilled off under reduced pressure to provide 81 g of a residue. The residue was purified by silica gel column chromatography (solvent: ethyl acetate-chloroform) to provide 59 g of product. The product was dissolved in 150 ml of methanol and after adding 10 g of sodium hydroxide and 100 ml of water to the solution, the mixture was stirred for 4 hours at 30° C. After the reaction was over, the product thus formed was poured in a diluted aqueous hydrochloric acid solution, extracted with ethyl acetate, and the extract was washed with water. Then, the solvent was distilled off from the extract under reduced pressure and the residue was crystallized from a mixture of ethyl acetate and n-hexane to 41 g of desired Coupler No. 1 having a melting point of 120° to 122° C.

| Elemental Analysis | C | H | N |
|---|---|---|---|
| Found (%) | 63.61 | 7.33 | 5.46 |
| Calculated (%) | 63.72 | 7.35 | 5.57 |

SYNTHESIS EXAMPLE 2

Synthesis of Coupler No. 11

To 240 ml of concentrated sulfuric acid was added 102 g of 5-fluoro-2-methylbenzoxazole under ice-cooling, then a mixture of 70 ml of nitric acid (d=1.40) and 100 ml of concentrated sulfuric acid was added dropwise to the mixture at a temperature below 5° C., and thereafter, the mixture was stirred for 1 hour at room temperature. The reaction mixture thus formed was poured into ice water and the crystals thus precipitated were collected by filtration, washed with water, dried and recrystallized from ethanol to provide 81 g of product [A'].

Then, 76 g of p-methoxyphenol was dissolved in 500 ml of tetrahydrofuran and after further adding 16 g of 60% sodium hydride to the solution, the mixture was stirred for 15 minutes. Thereafter, a solution of 80.5 g of the product [A'] dissolved in 300 ml of tetrahydrofuran was added dropwise to the mixture and the reaction was performed for 3 hours at 35° C. After distilling off 400 ml of tetrahydrofuran from the reaction mixture under reduced pressure, the reaction product was extracted with ethyl acetate and the extract was washed with water. Then, the solvent was distilled off from the extract under reduced pressure and the residue was crystallized from ether to provide 102 g of product [B].

Then, after performing a reaction of a mixture of 90 g of the product [B], 50 ml of concentrated sulfuric acid, and 500 ml of ethanol for 4 hours at 70° C., the reaction mixture was poured into water and crystals thus precipitated were collected by filtration and washed with water to provide 80 g of product [C].

Then, 55.4 g of the product [C] was added to acetonitrile and after adding thereto 66.6 mg of p-phenoxycarbonylaminophenyl butylsulfone and 1.4 g of imidazole, the mixture was refluxed for 4 hours. The reaction mixture thus formed was cooled, 200 ml of water was added thereto, and crystals thus precipitated were collected by filtration to provide 87 g of product [D].

Then, 62 g of the product [D] and 2 g of palladium-carbon were added to 250 ml of dimethylacetamide and the product was subjected to a catalytic reduction in an autoclave. After absorption of a theoretical amount of hydrogen, the catalyst was filtered off and 42.6 g of 2-(2,4-di-tert-amylphenoxy)butyryl chloride was added to the filtrate thus obtained, followed by stirring for 2 hours at 60° C. The reaction mixture thus obtained was poured into water, extracted with ethyl acetate, and after washing the extract with water, the solvent was distilled off under reduced pressure. The residue was purified by silica gel column chromatography (solvent: ethyl acetate-chloroform) and, then, crystallized using a mixture of ethyl acetate and n-hexane to provide 61 g of Coupler No. 11.

| Elemental Analysis | C | H | N |
|---|---|---|---|
| Found (%) | 66.97 | 7.19 | 5.21 |
| Calculated (%) | 67.15 | 7.17 | 5.34 |

Other couplers of this invention can be prepared by processes similar to the above processes.

The silver halide photographic emulsion containing the coupler of this invention may further contain other dye-forming couplers in addition to the coupler of this invention. Preferred example of such a coupler is a nondiffusible coupler having a hydrophobic group called as "ballasting group" in the molecule. The coupler may be of 4-equivalent or 2-equivalent to silver ions. Moreover, the silver halide photographic emulsion may further contain a colored coupler having a color correction effect, or a coupler releasing a development inhibitor with development (so-called DIR coupler). The coupler may also be a coupler forming a colorless product by a coupling reaction.

As yellow-coloring couplers, known open-chain ketomethylene series couplers can be used. Among these couplers, benzoylacetanilide series compounds and pivaloylacetanilide series compounds are advantageously used.

As magenta-coloring couplers, there are pyrazolone series compounds, indazolone series compounds, pyrazoloimidazole series compounds, pyrazolopyrazole series compounds, pyrazolotriazole series compounds, cyanoacetyl compounds, etc., and among these compounds, pyrazolone series compounds are particularly advantageous.

As cyan-coloring couplers, phenol series compounds, naphthol series compounds, etc., can be used.

In this invention, two or more kinds of couplers of this invention may be incorporated in the same layer, or a coupler of this invention may be incorporated in two or more layers.

The coupler of this invention can be added to a nonsensitive layer (such as an interlayer) in addition to a silver halide emulsion layer. When added to a silver halide emulsion layer, the coupler of the present invention is added in an amount of generally $2\times10^{-3}$ mole to $5\times10^{-1}$ mole, preferably $1\times10^{-2}$ mole to $5\times10^{-1}$ mole, per mole of silver in the emulsion layer. When used together with other couplers as described above, it is desirable that the total addition amount of the couplers which form the same color is within the above-described range.

The above-described couplers can be introduced into a silver halide emulsion layer by a known method, such as the method described, for example, in U.S. Pat. No. 2,322,027. For example, the coupler or couplers are dissolved in a high boiling organic solvent such as a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., octyl benzoate, etc.), an alkylamide (e.g., diethyllaurylamide, etc.), a fatty acid ester (e.g., dibutoxyethyl succinate, dioctyl azerate, etc.), etc., or in a low boiling organic solvent having a boiling point of about 30° C. to 150° C., such as a lower alkyl acetate (e.g., ethyl acetate, butyl acetate, etc.), ethyl propionate, secondary butyl alcohol, methyl isobutyl ketone, β-ethoxyethyl acetate, methyl cellosolve acetate, etc., and then the solution is dispersed in an aqueous solution of a hydrophilic colloid. The above-described high boiling organic solvent and low boiling organic solvent may be used as a mixture thereof.

Also, the dispersing method by a polymer described in Japanese Patent Publication No. 39853/76 and Japanese Patent Application (OPI) No. 59943/76 can be used for incorporating the couplers in a silver halide emulsion layer.

When the coupler has an acid group, such as a carboxylic acid group or a sulfonic acid group, the coupler is incorporated in an aqueous hydrophilic colloid solution as an alkaline aqueous solution thereof.

The color photographic material of this invention may contain an ultraviolet absorbent in a hydrophilic colloid layer thereof. Examples of the ultraviolet absorbent are benzotriazole compounds substituted by an aryl group (described, for example, in U.S. Pat. No. 3,533,794), 4-thiazolidone compounds (described, for example, in U.S. Pat. Nos. 3,314,794 and 3,352,681), benzophenone compounds (described, for example, in Japanese Patent Application (OPI) No. 2784/71), cinnamic acid ester compounds (described, for example, in U.S. Pat. Nos. 3,705,805 and 3,707,375), butadiene compounds (described, for example, in U.S. Pat. No. 4,045,229), and benzoxazole compounds (described, for example, in U.S. Pat. No. 3,700,455). Furthermore, the ultraviolet absorbents described in U.S. Pat. No. 3,499,762 and Japanese Patent Application (OPI) No. 48535/79 can be used in this invention. Also, ultraviolet absorbing couplers (e.g., α-naphthol series cyan dye-forming couplers) or ultraviolet absorbing polymers may be used as ultraviolet absorbents. These ultraviolet absorbents may be mordanted in a particular layer.

The photographic silver halide emulsions which are used in this invention can be prepared by the methods described in P. Glafkides, *Chimie et Physique Photographique* (published by Paul Montel Co., 1967), G. F. Duffin, *Photographic Emulsion Chemistry* (published by The Focal Press, 1966), V. L. Zelikman et al., *Making and Coating Photographic Emulsion* (published by The Focal Press, 1964). That is, the silver halide emulsions may be prepared by an acid method, a neutralization method, an ammonia method, etc., and the reaction of a soluble silver salt and a soluble halide may be performed by one side mixing method, a simultaneous addition mixing method, or a combination of these methods.

A process in which particles are formed under an excess amount of silver ions (the so-called reversal mixing) can also be used. A simultaneous mixing process in which the pAg of the liquid phase from which the silver halide is formed is kept at a constant value (the so-called controlled double jet process) can also be used. According to these methods, a silver halide emulsion having a regular crystal form and almost uniform grain size is obtained.

Moreover, two or more silver halide emulsions prepared separately may be used as a mixture thereof.

The coupler of this invention can be used together with a silver halide emulsion having a tubular grain form, in particular, a silver halide emulsion wherein the grains having a grain diameter/thickness ratio of higher than 5, more particularly higher than 8, occupy more than 50% of the total projected area.

The formation of silver halide grains or the physical ripening of silver halide grains can be performed in the presence of a cadmium salt, a zinc salt, a lead salt, a thallium salt, an iridium salt or a complex salt thereof, a rhodium salt or a complex salt thereof, an iron salt or a complex salt thereof, etc.

As a binder or a protective colloid for silver halide photographic emulsions which are used for the silver halide color photographic materials of this invention, gelatin is advantageously used, but other hydrophilic colloids may be used.

For example, as such hydrophilic colloids, there are gelatin derivatives; graft polymers of gelatin and other polymers; proteins such as albumin, casein, etc.; cellulose derivatives, such as hydroxyethyl cellulose, carboxymethyl cellulose, cellulose sulfuric acid esters, etc.; sugar derivatives, such as sodium alginate, starch derivatives, etc.; and various synthetic hydrophilic polymers or copolymers such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole, etc.

As gelatin lime-treated gelatin, acid-treated gelatin, and the enzyme-treated gelatin as described in *Bull. Soc. Sci. Phot. Japan,* No. 16, page 30 (1966) can be used, and a hydrolyzed product of an enzyme-decomposition product of gelatin can also be used.

The silver halide photographic emulsions which are used in this invention can further contain various additives for preventing the occurrence of fog during the production, storage, or photographic processing of the color photographic materials of this invention or for stabilizing the photographic properties of the color photographic materials. Examples of such additives include various compounds known as antifoggants or stabilizers, for example, azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole), etc.; mercaptopyrimidines; mercaptotriazines; thioketo compounds such as oxazolinethione, etc.; azaindenes such as triazaindenes, tetraazaindenes (in particular, 4-hydroxy-substituted (1,3,3a,7)tetraazaindenes), pentaazaindenes, etc.; benzenethiosulfonic acid, benzenesulfinic acid, benzenesulfonic acid amide, etc.

The photographic silver halide emulsion layers of the photographic materials of this invention may further contain polyalkylene oxides or the derivatives thereof, such as the ethers, esters, amines, etc., thereof, thioether compounds, thiomorpholines, quaternary ammonium salt compounds, urethane derivatives, urea derivatives, imidazole derivatives, 3-pyrazolidones, etc., for the purposes of increasing sensitivity, increasing contrast, and accelerating development.

The photographic silver halide emulsions which are used in this invention may be spectrally sensitized by methine dyes or other dyes. Dyes used for this purpose include cyanine dyes, merocyanine dyes, complex cyanine dyes, complex merocyanine dyes, holopolar cyanine dyes, hemicyanine dyes, styryl dyes and hemioxonol dyes. Particularly useful dyes are those belonging to cyanine dyes, merocyanine dyes, and complex merocyanine dyes. To these dyes can be applied nuclei usually utilized for cyanine dyes, such as basic heterocyclic nuclei. Examples of these nuclei are pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; the nuclei formed by fusing alicyclic hydrocarbon rings to these nuclei; and the nuclei formed by fusing aromatic hydrocarbon rings to these nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. These nuclei may be substituted on carbon atoms thereof.

To merocyanine dyes or complex merocyanine dyes can be applied 5-membered or 6-membered heterocyclic nuclei such as pyrazolin-5-one nucleus, thiohydantoin nucleus, 2-thiooxazolidine-2,4-dione nucleus, thiazolidine-2,4-dione nucleus, rhodanine nucleus, thiobarbituric acid nucleus, etc., as a nucleus having a ketomethylene structure.

These sensitizing dyes may be used singly or as a combination thereof. A combination of sensitizing dyes is frequently used for the purpose of supersensitization.

Moreover, the photographic silver halide emulsions in this invention may further contain dyes having no spectral sensitization action by themselves or materials which do not substantially absorb visible rays and show supersensitizing effect. Examples of such materials are aminostilbene compounds substituted by nitrogen-containing heterocyclic groups, aromatic organic acid formaldehyde condensation products, cadmium salts, azaindene compounds, etc.

The photographic materials of this invention may contain filter dyes or water-soluble dyes for irradiation prevention or other purposes. These dyes include oxonol dyes, hemioxonol dyes, styryl dyes, merocyanine dyes, cyanine dyes, and azo dyes. Among these dyes, oxonol dyes, hemioxonol dyes and merocyanine dyes are advantageous.

The photographic materials of this invention may further contain in the photographic silver halide emulsion layers or in other hydrophilic colloid layers stilbene series, triazine series, oxazole series, or cumarin series brightening agents. These materials may be water-soluble or water-insoluble whitening agents. When they are water-insoluble, they may be used in the form of dispersions. Practical examples of the brightening agents are described, for example, in U.S. Pat. Nos. 2,632,701, 3,269,840 and 3,359,102, and British Patent Nos. 852,075 and 1,319,763.

At the practice of this invention, the following fading preventing agents may be used and, also, the color image stabilizers which are used in this invention can be used solely or as a combination of two or more these stabilizers. Examples of the fading preventing agents are the hydroquinone derivatives described in U.S. Pat. Nos. 2,360,290, 2,418,613, 2,675,314, 2,701,197, 2,704,713, 2,728,659, 2,732,300, 2,735,765, 2,710,801 and 2,816,028, British Patent No. 1,363,921; the gallic acid derivatives described in U.S. Pat. Nos. 3,457,079, 3,069,262, etc.; the p-alkoxyphenols described in U.S. Pat. Nos. 2,735,765 and 3,698,909, Japanese Patent Publication Nos. 20977/74, 6623/77, etc.; p-oxyphenol derivatives described in U.S. Pat. Nos. 3,432,300, 3,573,050, 3,574,627 and 3,764,337, Japanese Patent Application (OPI) Nos. 35633/77, 147434/77 and 152225/77; and bisphenols described in U.S. Pat. No. 3,700,455.

The sensitive material prepared in accordance with the present invention may contain as a color fog-preventing agent a hydroquinone derivative, an aminophenol derivative, a gallic acid derivative, an ascorbic acid derivative or so on.

This invention can be applied to a multilayer multicolor photographic material having at least two differently spectrally sensitized silver halide photographic emulsion layers on a support. The multilayer natural color photographic material usually has at least one red-sensitive silver halide emulsion layer, at least one green-sensitive silver halide emulsion layer, and at least one blue-sensitive silver halide emulsion layer on a support. The order of the disposition of these emulsion layers can be suitably selected. It is usual that the red-sensitive silver halide emulsion layer contains a cyan-forming coupler, the green-sensitive silver halide emulsion layer contains a magenta-forming coupler, and the blue-sensitive silver halide emulsion layer contains a yellow-forming coupler, but different combinations may be employed, if desired.

The photographic materials of this invention can be processed by any known processes. For the photographic processings, known processing solutions can be used. The processing temperature can be usually selected from the range of 18° C. to 50° C. but the temperature may be below 15° C. or over 50° C.

A color developer which is used for developing the color photographic material of this invention is generally composed of an alkaline aqueous solution containing a color developing agent. The color developing agent includes known primary amine color developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

Furthermore, the color developing agents described, for example, in L. F. A. Mason, *Photographic Processing Chemistry,* pages 226–229 (published by Focal Press, 1966), U.S. Pat. Nos. 2,913,015 and 2,592,364, and Japanese Patent Application (OPI) No. 64933/73 may be used in this invention.

The color developers which are used for developing the color photographic materials of this invention can further contain pH buffers such as sulfites, carbonates, borates, and phosphates of alkali metals and development inhibitors and antifoggants such as bromides, iodides, and organic antifoggants. Also, if desired, the color developers may further contain water softeners; organic solvents such as benzyl alcohol, diethylene glycol, etc.; preservatives such as hydroxylamine, etc.; development accelerators such as polyethylene glycol, quaternary ammonium salts, amines, etc.; dye-forming couplers; competing couplers; fogging agents such as sodium borohydride, etc.; auxiliary developing agents such as 1-phenyl-3-pyrazolidone, etc.; tackifiers; the polycarboxylic acid series chelating agents described in U.S. Pat. No. 4,083,723; and the antioxidants described in West German Patent Application (OLS) No. 2,622,950.

The photographic silver halide emulsion layers of the color photographic materials are usually bleached after color development. The bleaching process may be performed simultaneously with a fixing process or separately from the fixing process.

As the bleaching agents, compounds of polyvalent metals such as iron (III), cobalt (III), chromium (IV), cobalt (II), etc.; peracids; quinones; nitroso compounds; etc., are used. For example, there are ferricyan compounds; dichriomates; organic complex salts of iron (III) or cobalt (III); complex salts of aminopolycarboxylic acids such as ethylenediaminetetraacetic acid, nitrilotriacetic acid, 1,3-diamino-2-propanoltetraacetic acid, etc., or organic acids such as citric acid, tartaric acid, malic acid, etc.; persulfates; permanganates; nitrosophenol, etc. Among these compounds, potassium ferricyanide, ethylenediaminetetraacetic acid iron (III) sodium and ethylenediaminetetraacetic acid iron (III) ammonium are particularly advantageous. The ethylenediaminetetraacetic acid iron (III) complex salt is useful in both an independent bleaching solution and a monobath type blix solution.

The bleach solution or blix solution may further contain various additives such as the bleaching accelerators described in U.S. Pat. Nos. 3,042,520 and 3,241,966, Japanese Patent Publication Nos. 8506/70 and 8836/70, the thiol compounds described in Japanese Patent Application (OPI) No. 65632/78, etc.

The invention is further described below by the following examples, but the invention is not limited thereto.

EXAMPLE 1

Each of the samples was prepared by coating, in succession, the following silver halide emulsion layers and a protective layer on a cellulose triacetate film support.

To 100 g of Coupler No. 1 were added 100 ml of dibutyl phthalate and 100 ml of ethyl acetate and the coupler was dissolved therein by heating to 60° C. The solution thus prepared was mixed with 1,000 ml of an aqueous solution containing 100 g of gelatin and 10 g of sodium dodecylbenzenesulfonate at 50° C. and the mixture was stirred at high speed by means of a homogenizer to provide a finely dispersed coupler dispersion.

To 350 g of the coupler dispersion was added 1 kg of a silver iodobromide emulsion containing 80 g of the silver and having a silver iodide/silver bromide mole ratio of 6/94. The resulting emulsion was coated on the above-described support at a coupler coverage of $7\times10^{-4}$ mole/m$^2$. Then, a gelation protective layer was coated on the emulsion layer at a dry thickness of 1 micron to provide Sample 1A.

By following the same procedure as above using each of Coupler Nos. 3 and 15 in such a manner that the coupler coverage (mole/m$^2$) and the mixing mole ratio of the coupler and silver were same as those of Sample 1A, Sample 1B and Sample 1C were prepared.

Furthermore, by following the same procedure as the case of preparing Sample 1A except that following known Couplers 101 and 102 were used as comparison couplers, Sample 1D and Sample 1E were prepared.

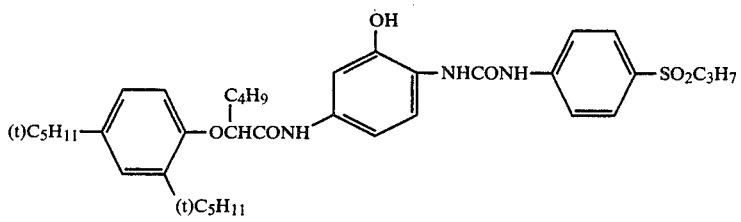

Coupler 101

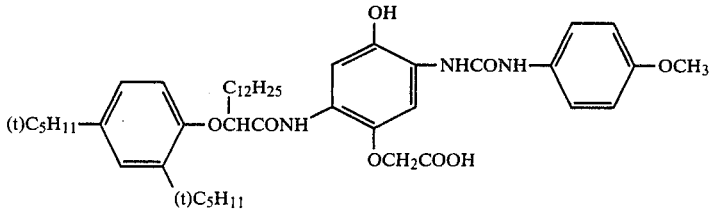

Coupler 102

Each of these samples was exposed through a wedge for sensitometry and then processed by the following processing steps at 38° C.:

1. Color Development: 3 min 15 sec
2. Bleach: 6 min 30 sec
3. Wash: 3 min 15 sec
4. Fix: 6 min 30 sec
5. Wash: 3 min 15 sec
6. Stabilization: 3 min 15 sec The compositions of the processing solutions used for the above processing steps were as follows:

Color Developer

Sodium Nitrilotriacetate: 1.0 g
Sodium Sulfite: 4.0 g
Sodium Carbonate: 30.0 g
Potassium Bromide: 1.4 g
Hydroxylamine Sulfate: 2.4 g
4-(N-Ethyl-N-β-hydroxyethylamino)-2-methylaniline Sulfate: 4.5 g
Water to make: 1 liter Bleach Solution Ammonium Bromide: 160.0 g
Aqueous Ammonia (28%): 25.0 ml
Ethylenediaminetetraacetic Acid Sodium Iron Salt: 130.0 g
Glacial Acetic Acid: 14.0 ml
Water to make: 1 liter Fix Solution Sodium Tetrapolyphosphate: 2.0 g
Sodium Sulfite: 4.0 g
Ammonium Thiosulfate (70%): 175.0 ml
Sodium Hydrogensulfite: 4.6 g
Water to make: 1 liter Stabilization Solution Formaldehyde: 8.0 ml
Water to make: 1 liter The density of the images of the processed samples was measured by red light and the results thus obtained are shown in Table 1.

TABLE 1

| Sample No. | Coupler | Relative Sensitivity | Maximum Density |
|---|---|---|---|
| 1A | Coupler 1 (Invention) | 100 | 1.48 |
| 1B | Coupler 3 (Invention) | 101 | 1.51 |

TABLE 1-continued

| Sample No. | Coupler | Relative Sensitivity | Maximum Density |
|---|---|---|---|
| 1C | Coupler 15 (Invention) | 98 | 1.43 |
| 1D | Coupler 101 (Comparison) | 78 | 1.10 |
| 1E | Coupler 102 (Comparison) | 85 | 1.32 |

As is clear from the results shown in Table 1, the couplers in this invention show significantly improved sensitivity as compared to the comparison couplers. Also, the peak wavelength of the absorption spectrum of the colored dye and the cut state of the absorption spectrum at the short wavelength side are satisfactory in the case of using the coupler of this invention.

Next, the fastness of each developed sample film was tested. The fastness of the developed samples when they were allowed to stand in the dark for 14 days at 80° C., the fastness of the developed samples when they were allowed to stand in the dark for 6 weeks at 60° C. and 70% RH, and the fastness of the developed samples when they were exposed to light for 6 days using a xenon test machine (100,000 lux) were determined by measuring the reduction in density at an initial density of 1.0 in each case. The fastness was evaluated by a percentage of the drop in density caused by the forced deterioration under the above-described conditions. The results thus obtained are shown in Table 2.

TABLE 2

| Film Sample No. | Coupler | Percentage of Drop in Color Image Density: 14 Days at 80° C. (%) | 6 Weeks at 60° C. 70% RH (%) | 6 Days to Xenon Light (%) |
|---|---|---|---|---|
| 1A | Coupler 1 (Invention) | 1 | 1 | 3 |
| 1B | Coupler 3 (Invention) | 1 | 2 | 4 |
| 1C | Coupler 15 (Invention) | 2 | 3 | 3 |
| 1D | Coupler 101 (Comparison) | 1 | 2 | 4 |
| 1E | Coupler 102 (Comparison) | 3 | 4 | 6 |

As is clear from the results shown in Table 2, the heat resistance of the color images formed by the couplers in this invention is very satisfactory.

EXAMPLE 2

A multilayer color photographic material was prepared by forming the following layers on a cellulose triacetate film support.

FIRST LAYER

Antihalation Layer

A gelatin layer containing black colloid silver.

SECOND LAYER

Interlayer

A gelatin layer containing an emulsified dispersion of 2,5-di-t-octylhydroquinone.

THIRD LAYER

First Red-Sensitive Emulsion Layer

A layer containing a silver iodobromide emulsion (silver iodide: 5 mole%) at a silver coverage of 1.6 g/m$^2$, Sensitizing Dye I in an amount of $4.5\times10^{-4}$ mole per mole of silver, Sensitizing Dye II in an amount of $1.5\times10^{-5}$ mole per mole of silver, Coupler 101 in an amount of 0.04 mole per mole of silver, Coupler EX-3 in an amount of 0.003 mole per mole of silver, and Coupler EX-9 in an amount of 0.0006 mole per mole of silver.

FOURTH LAYER

Second Red-Sensitive Emulsion Layer

A layer containing a silver iodobromide emulsion (silver iodide: 10 mole%) at a silver coverage of 1.4 g/m$^2$, Sensitizing Dye I in an amount of $3\times10^{-4}$ mole per mole of silver, Sensitizing Dye II in an amount of $1\times10^{-4}$ mole per mole of silver, Coupler 1 in an amount of 0.022 mole per mole of silver, and Coupler EX-3 in an amount of 0.0016 mole per mole of silver.

FIFTH LAYER

Interlayer

Same as the second layer.

SIXTH LAYER

First Green-Sensitive Emulsion Layer

A layer containing a silver iodobromide emulsion (silver iodide: 4 mole%) at a silver coverage of 1.2 g/m$^2$, Sensitizing Dye III in an amount of $5\times10^{-4}$ mole per mole of silver, Sensitizing Dye IV in an amount of $2\times10^{-4}$ mole per mole of silver, Coupler EX-4 in an amount of 0.05 mole per mole of silver, Coupler EX-5 in an amount of 0.008 mole per mole of silver, and Coupler EX-9 in an amount of 0.0015 mole per mole of silver.

SEVENTH LAYER

Second Green-Sensitive Emulsion Layer

A layer containing a silver iodobromide emulsion (silver iodide: 8 mole%) at a silver coverage of 1.3 g/m$^2$, Sensitizing Dye III in an amount of $3\times10^{-4}$ mole per mole of silver, Sensitizing Dye IV in an amount of $1.2\times10^{-4}$ mole per mole of silver, Coupler EX-7 in an amount of 0.017 mole per mole of silver, Coupler EX-6 in an amount of 0.003 mole per mole of silver, and Coupler EX-10 in an amount of 0.0003 mole per mole of silver.

EIGHTH LAYER

Yellow Filter Layer

A gelatin layer containing yellow colloid silver and an emulsified dispersion of 2,5-di-t-octylhydroquinone.

NINTH LAYER

First Blue-Sensitive Emulsion Layer

A layer containing a silver iodobromide emulsion (silver iodide: 6 mole%) at a silver coverage of 0.7 g/m$^2$, Coupler EX-8 in an amount of 0.25 mole per mole of silver, and Coupler EX-9 in an amount of 0.015 mole per mole of silver.

TENTH LAYER

Second Blue-Sensitive Layer

A layer containing a silver iodobromide emulsion (silver iodide: 6 mole%) at a silver coverage of 0.6 g/m$^2$ and Coupler EX-8 in an amount of 0.06 mole per mole of silver.

ELEVENTH LAYER

First Protective Layer

A gelatin layer containing a silver iodobromide emulsion (silver iodide: 1 mole%, mean grain size: 0.07$\mu$) at a silver coverage of 0.5 g/m$^2$, and an emulsified dispersion of ultraviolet absorbent UV-1.

TWELFTH LAYER

Second Protective Layer

A gelatin layer containing trimethyl methacrylate particles (diameter of about 1.5$\mu$).

In each of the above layers were further incorporated gelatin hardening agent H-1 and a surface active agent in addition to the above-described additives. Thus, Sample 2A was prepared.

The additives used for preparing Sample 2A were as follows.

EX-3

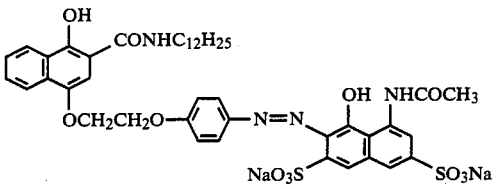

EX-4

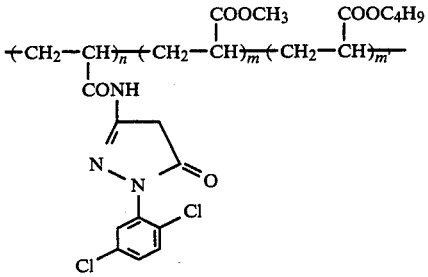

n/m + m' = 1 (by weight)

n/m' = 1 (by weight)

Molecular weight = about 4,000

-continued

EX-5

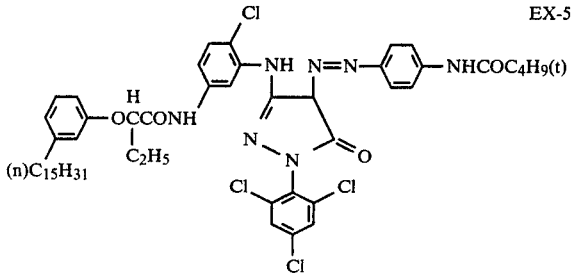

EX-6

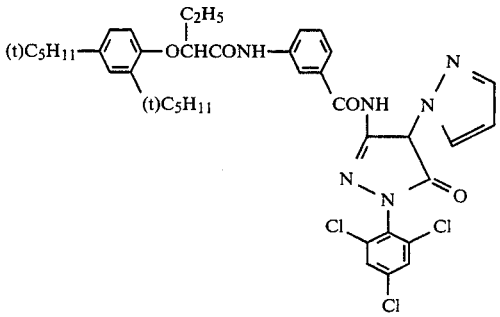

EX-7

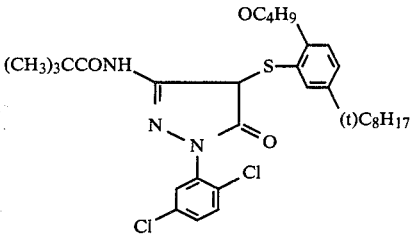

EX-8

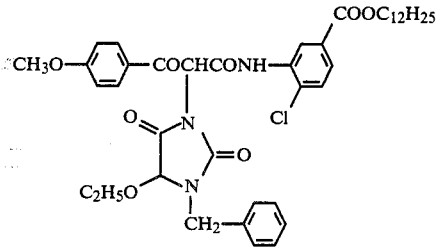

EX-9

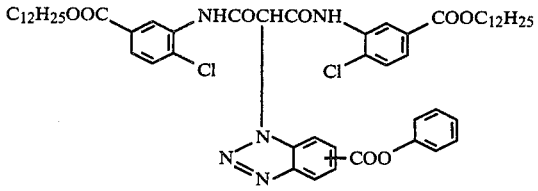

EX-10

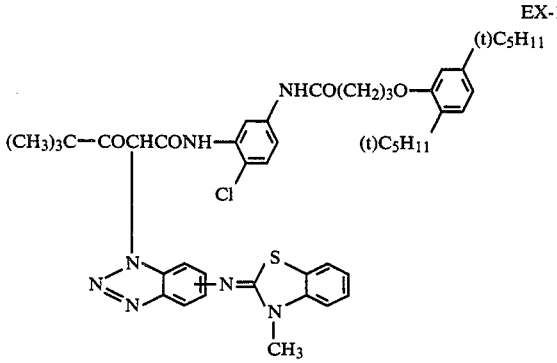

-continued

H-1

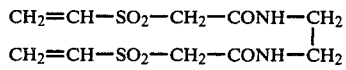

UV-1

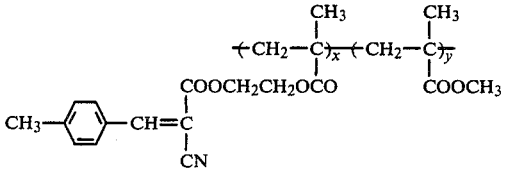

x/y = 7/3 (by weight)

Sensitizing Dye I

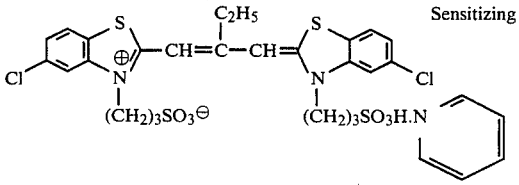

Sensitizing Dye II

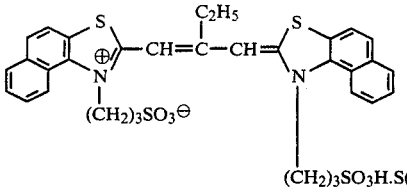

Sensitizing Dye III

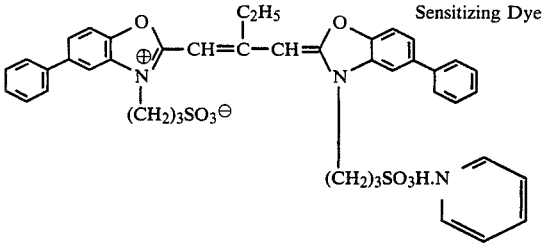

Sensitizing Dye IV

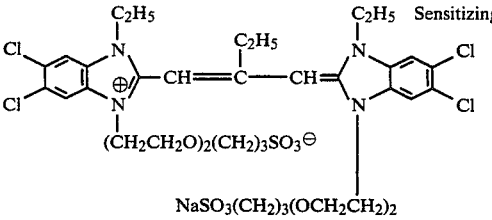

The sample was sensitometrically exposed to white light and processed in the same processings as in Example 1.

Also, by following the same procedure as the case of preparing Sample 2A except that each of Coupler 15 of this invention, Comparison Couplers 101 and 102 was used in place of Coupler 1 in the fourth layer of Sample 2A, Samples 2B, 2C, and 2D, respectively, were prepared.

Furthermore, by following the same procedure as above except that Comparison Coupler 101 was used in place of Coupler No. 1 in the fourth layer of Sample 2A and the coverage thereof was changed to 0.031 mole per mole of silver, Sample 2E was prepared.

These comparison samples were also exposed to white light and processed as described above.

The optical densities of the developed samples were measured by red light, and the results are shown in Table 3 below. In addition, R.M.S. granularity (Root Mean Square granularity) of cyan image obtained was determined at the density of 0.5. Data on R.M.S. granularity obtained for the respective samples are also shown in Table 3.

TABLE 3

| Film Sample No. | Couplers in 1st Red-Sensitive Emulsion Layer | Couplers in 2nd Red-Sensitive Emulsion Layer | Relative Sensitivity | RMS Granularity (D = fog + 0.5) |
|---|---|---|---|---|
| 2A | 101/EX-3/EX-9 | 1/EX-3 | 100 | 0.008 |
| 2B | 101/EX-3/EX-9 | 15/EX-3 | 98 | 0.007 |
| 2C | 101/EX-3/EX-9 | 101/EX-3 | 82 | — |
| 2D | 101/EX-3/EX-9 | 102/EX-3 | 92 | — |
| 2E | 101/EX-3/EX-9 | 101*/EX-3 | 96 | 0.013 |

*:The coverage of Coupler 101 was 1.4 times that of Sample 2C.
(Note): Samples 2A and 2B are samples of this invention.
Samples 2C, 2D and 2E are comparison samples.

As is clear from the results in Table 3, it can be seen that the couplers of this invention show significantly improved sensitivity and excellent granularity of the images obtained using the couplers of this invention, even as compared to that of Sample 2E wherein the coverage of the comparison coupler was increased in order to increase the sensitivity.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least a silver halide emulsion layer wherein said photographic material contains a cyan dye-forming coupler represented by formula (I)

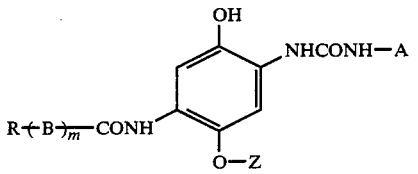

(I)

wherein R represents an unsubstituted or substituted alkyl, aryl, or heterocyclic ring group; B represents —O— or —$NR_1$—, wherein $R_1$ represents a hydrogen atom or an unsubstituted or substituted alkyl or aryl group; Z represents an unsubstituted or substituted aryl group or an alkyl or aralkyl group substituted by a carboxy group or a hydroxy group; A represents a substituted aryl group, or a substituted or unsubstituted heterocyclic ring group; and m represents 0 or 1, provided that when m is 0 the substituent is not an alkoxy group, a halogen atom, or a cyano group.

2. A silver halide color photographic material as claimed in claim 1, wherein the substituent for R is selected from the group consisting of an alkyl group, an aryl group, a heterocyclic ring group, an alkoxy group, an aryloxy group, a carboxy group, a carbonyl group, an ester group, an amido group, an imido group, a sulfonyl group, a hydroxy group, a cyano group, a nitro group and a halogen atom.

3. A silver halide color photographic material as claimed in claim 1, wherein the substituent for $R_1$ is selected from the group consisting of an alkyl group, an aryl group, a heterocyclic ring group, an alkoxy group, an aryloxy group, a carboxy group, a carbonyl group, an ester group, an amido group, an imido group, a sulfonyl group, a hydroxy group, a cyano group, a nitro group and a halogen atom.

4. A silver halide color photographic material as claimed in claim 1, wherein the substituent for the aryl group represented by Z is selected from the group consisting of a halogen atom, a cyano group, a hydroxy group, an alkoxy group, an aryloxy group, an acyloxy group, an acylamino group, a sulfonamido group, a sulfamoyl group, a sulfonyl group, a carboxy group, a sulfo group, a nitro group, an arylthio group, an alkylthio group, a carbamoyl group, an alkoxycarbonyl group, a sulfinyl group, a phosphoric acid amido group, and a heterocyclic group.

5. A silver halide color photographic material as claimed in claim 1, wherein the substituent for A is selected from the group consisting of an alkyl group, an aryl group, a heterocyclic group, an alkoxy group, an aryloxy group, a carboxy group, a carbonyl group, an ester group, an amido group, a sulfonamido group, an imido group, a ureido group, a sulfonyl group, a hydroxy group, a cyano group, a nitro group, a halogen atom, and a thio group, provided that when m is 0, the substituent for A is not an alkoxy group, a halogen atom, or a cyano group.

6. A silver halide color photographic material as claimed in claim 1, wherein R represents a substituted alkyl group or a substituted aryl group.

7. A silver halide color photographic material as claimed in claim 1, wherein B represents —O—.

8. A silver halide color photographic material as claimed in claim 1, wherein said cyan dye-forming coupler represented by formula (I) is present in a silver halide emulsion layer.

9. A silver halide color photographic material as claimed in claim 8, wherein the silver halide emulsion layer containing the cyan dye-forming coupler represented by formula (I) is a red-sensitive silver halide emulsion layer.

10. A silver halide color photographic material comprising a support having thereon at least one red-sensitive silver halide emulsion layer, at least one green-sensitive silver halide emulsion layer, and at least one blue-sensitive silver halide emulsion layer, said red-sensitive silver halide emulsion layer containing a cyan dye-forming coupler represented by formula (I)

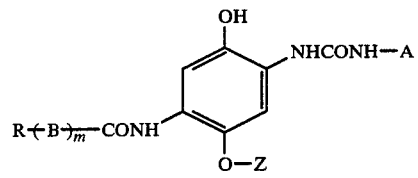

(I)

wherein R represents an unsubstituted or substituted alkyl, aryl, or heterocyclic ring group; B represents —O— or —$NR_1$—, wherein $R_1$ represents a hydrogen atom or an unsubstituted or substituted alkyl or aryl group; Z represents an unsubstituted or substituted aryl or an alkyl group, or aralkyl group substituted by a carboxy group or a hydroxy group; A represents a substituted aryl group, or a substituted or unsubstituted heterocyclic ring group; and m represents 0 or 1, provided that when m is 0 the substituent is not an alkoxy group a halogen atom, or a cyano group.

* * * * *